US008127702B2

(12) United States Patent
Scarcello et al.

(10) Patent No.: US 8,127,702 B2
(45) Date of Patent: Mar. 6, 2012

(54) MODIFIED BUOY SYSTEM

(76) Inventors: Robert Scarcello, Greenlawn, NY (US); Maureen Scarcello, Greenlawn, NY (US)

( * ) Notice: Subject to any disclaimer, the term of this patent is extended or adjusted under 35 U.S.C. 154(b) by 105 days.

(21) Appl. No.: 12/128,118

(22) Filed: May 28, 2008

(65) Prior Publication Data

US 2009/0298366 A1 Dec. 3, 2009

(51) Int. Cl.
*B63B 21/12* (2006.01)

(52) U.S. Cl. ..... 114/221 R; 441/16

(58) Field of Classification Search ..... 441/16; 182/133, 189; 114/221 R
See application file for complete search history.

(56) References Cited

U.S. PATENT DOCUMENTS 3,077,614 A 2/1963 Lloyd
3,084,354 A 4/1963 Leunenschloss
3,486,672 A * 12/1969 Esopi ..... 280/814
3,605,359 A * 9/1971 Bader et al. ..... 52/146
3,618,150 A * 11/1971 Anselmi ..... 441/16
3,817,351 A * 6/1974 Mikkelson ..... 182/190
4,221,314 A * 9/1980 Baker, Jr. ..... 294/147
4,529,388 A 7/1985 Jones et al.
4,647,929 A * 3/1987 Jacobs ..... 340/985
4,763,126 A 8/1988 Jawetz
4,781,138 A * 11/1988 Hay ..... 114/221 R
4,793,646 A * 12/1988 Michaud, Jr. ..... 294/19.1
4,896,620 A * 1/1990 Jones ..... 114/253
5,088,948 A * 2/1992 Scheurer ..... 441/1
5,273,468 A * 12/1993 Nichols ..... 441/6
5,335,835 A * 8/1994 Hogan ..... 224/257
5,362,267 A * 11/1994 Forrest ..... 441/16
6,488,554 B2 12/2002 Walker
6,907,837 B2 6/2005 Pufahl
7,156,712 B1 * 1/2007 Mercer ..... 441/6

* cited by examiner

*Primary Examiner* — Stephen Avila
(74) *Attorney, Agent, or Firm* — Collard & Roe, P.C.

(57) ABSTRACT

There is a grasping device for a mast buoy comprising a body, at least one loop coupled to the body, and at least one locking element for locking the body to a shaft of a mast buoy. The grasping device can also optionally be coupled to a light such as a remote controlled light which can be turned on remotely using a switch and wireless communication. The grasping device can also include a telescoping body, adjustable loops, an annunciator, and a locating system as well. There can also be an optional solar panel coupled to the grasping device which can be used to charge a battery to provide power to a light.

24 Claims, 4 Drawing Sheets

MODIFIED BUOY SYSTEM

BACKGROUND

The invention relates to a modified buoy system including a grasping device for assisting a boating person with the grasping of a mast buoy. The grasping device can have at least one loop to aid the user in grasping the grasping device. Other grasping or locating devices are known such as from U.S. Pat. No. 7,156,712 to Mercer; U.S. Pat. No. 6,907,837 to Pufahl; U.S. Pat. No. 4,529,388 to Jones; U.S. Pat. No. 3,077,614 to Lloyd; U.S. Pat. No. 4,763,126 to Jawetz; U.S. Pat. No. 4,806,620 to Jones; U.S. Pat. No. 6,488,620 to Jones; U.S. Pat. No. 6,488,554 to Walker; U.S. Pat. No. 3,084,354 to Luenscholss. wherein the disclosures of these patents are hereby incorporated herein by reference in their entirety.

SUMMARY

One embodiment of the invention relates to a modified buoy system for a mast buoy comprising a body, at least one loop coupled to the body, and at least one locking element for locking the body to a shaft of a mast buoy. The grasping device can also optionally be coupled to a light such as a remote controlled light which can be turned on remotely using a switch and wireless communication. The grasping device can also include a telescoping body, adjustable loops, an annunciator, and a locating system as well. There can also be an optional solar panel coupled to the grasping device which can be used to charge a battery to provide power to a light.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION

Figure 1:
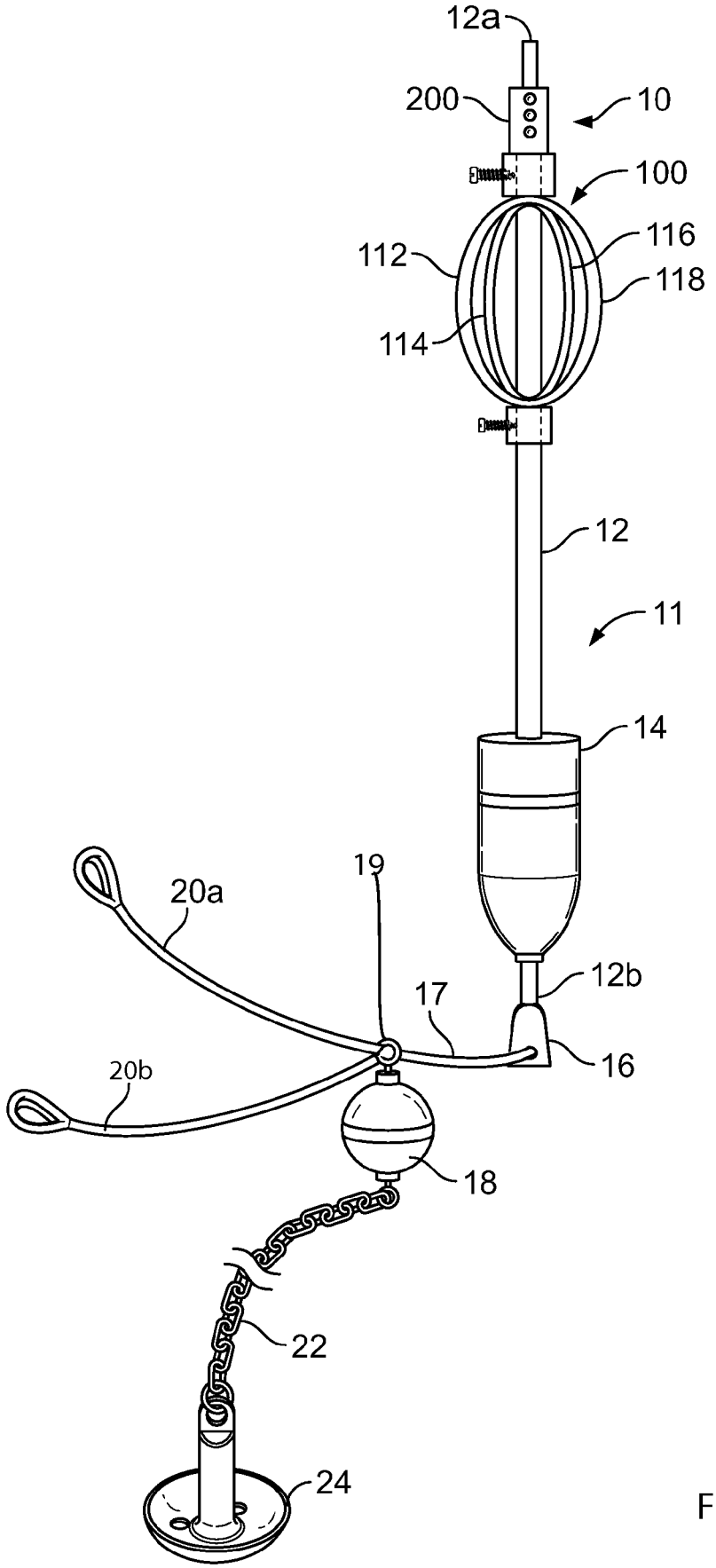
FIG. 1 is a side view of a modified buoy system and an electronic device coupled to a mast of a mast buoy.

Referring to the drawings, FIG. 1 is a side view of a finder device 10 including a grasping device 100 and an electronic device 200 coupled to a mast 12 of a mast buoy 11. Essentially grasping device 100 and electronic device 200 can be manufactured with mast buoy 11 or attached to an existing mast buoy as an after-market part. Mast buoy 11 includes a shaft 12 and a floatation element 14. Shaft 12 can be formed from any suitable material, however it is often formed from either wood, fiberglass plastic or composite material. Flotation element 14 can be formed from any suitable floatation material, such as foam, rubber or any other suitable floatation material. Shaft 12 has a free first end 12*a* and a second end 12*b* coupled to weight 16. Weight 16 is fixed to shaft 12 in any known manner. Weight 16 can be formed from any suitable material, but is commonly formed from a non-corrodible metal such as galvanized stainless steel or aluminum. Weight 16 is coupled via any known linking element 17 such as a cord, a chain, a cable or a rope to a mooring ball 18. Mooring ball 18 is a floatable object that can be formed in any suitable shape but is most commonly formed as a spherical or ball shaped object wherein a portion of this mooring usually floats above the surface of a body of water. Mooring ball 18 has a ring or an eyelet 19 which allows linking element 17 to pass therethrough. Coupled to mooring ball 18, or to linking element 17 is a line 20*a* and/or 20*b* which can be in the form of any suitable material such as a cord, cable, chain, rope etc. Coupled to an opposite end of mooring ball 18 is a chain 22 which is secured to an anchor 24 such as a mushroom anchor.

Figure 2:
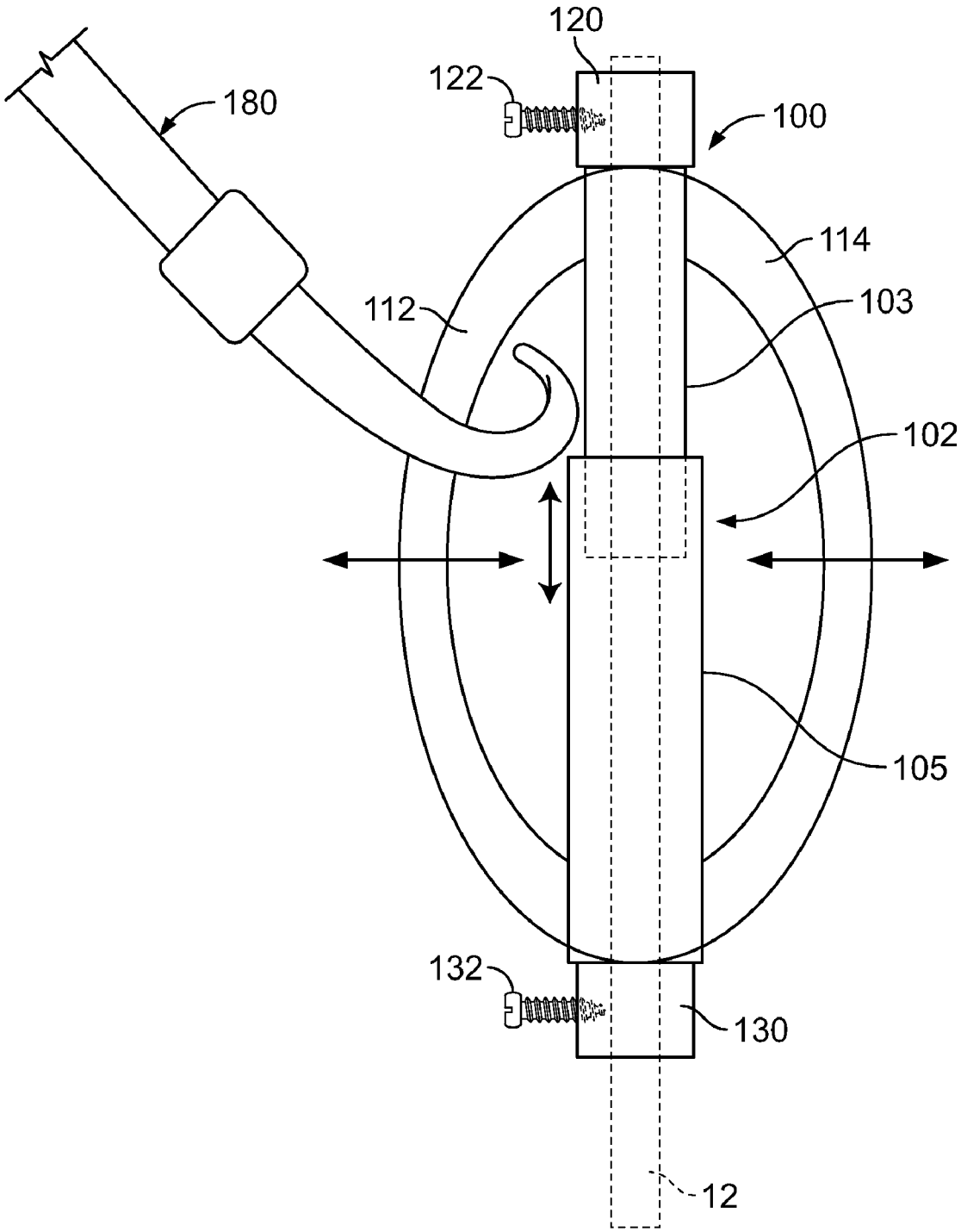
FIG. 2 is a side cross-sectional view of the modified buoy system shown in FIG. 1 coupled to the mast buoy.

Grasping device 100 is coupled to shaft 12 adjacent to first end 12*a*. In this case, the position of grasping device 100 can be adjusted along shaft 12 so that grasping device 100 can be positioned at different positions along shaft 12. As shown in FIG. 2 a plurality of locking elements, or couplers which can be in any form but are shown by way of example as collars 120 and 130 which can be used to secure the position of grasping device 100 along shaft 12.

Each collar 120 and 130 has an associated pin or set screw 122 and 132 respectively to set a position of collars 120 and 130 along shaft 12. Housing or body 102 can be in the form of a single shaft, or optionally include two telescoping shafts 103 and 105. Coupled to body 102 are loops 112, 114, 116, and 118 which are in the form of flexible loops which in at least one embodiment are formed integral with body 102. Alternatively, loops 112, 114, 116, and 118 are formed as attachable loops which are attachable to body 102. Flexible loops 112, 114, 116, and 118 are made from either the same material as body 102, or a different material. For example, body 102 and loops 112, 114, 116, and 118 can be formed from polyvinyl chloride material (PVC) or they can be formed from a different material such as rubber, or other plastic or metal type material. In at least one embodiment, this material is a flexible or elastic material such that loops 112, 114, 116, and 118 can be bent out in a lateral direction or compressed in laterally based upon movement of collars 120 and 130 inward towards each other or outward away from each other.

Once the position of each of these collars 120 and 130 are set, set screws 122 and 132 are screwed in so that tips of these screws intersect with shaft 12 so as to set the position of these collars via a frictional or structural intersection. Essentially, these set screws can contact or "bite" into shaft 12 to secure the position of these collars 120 and 130. Once grasping device 100 is set on shaft 12, it is positioned so that it can receive a boat hook such as boat hook 180 to hook through loops 112, 114, 116, or 118 to allow a user to haul in a mast buoy in a relatively easy manner.

Figure 3:
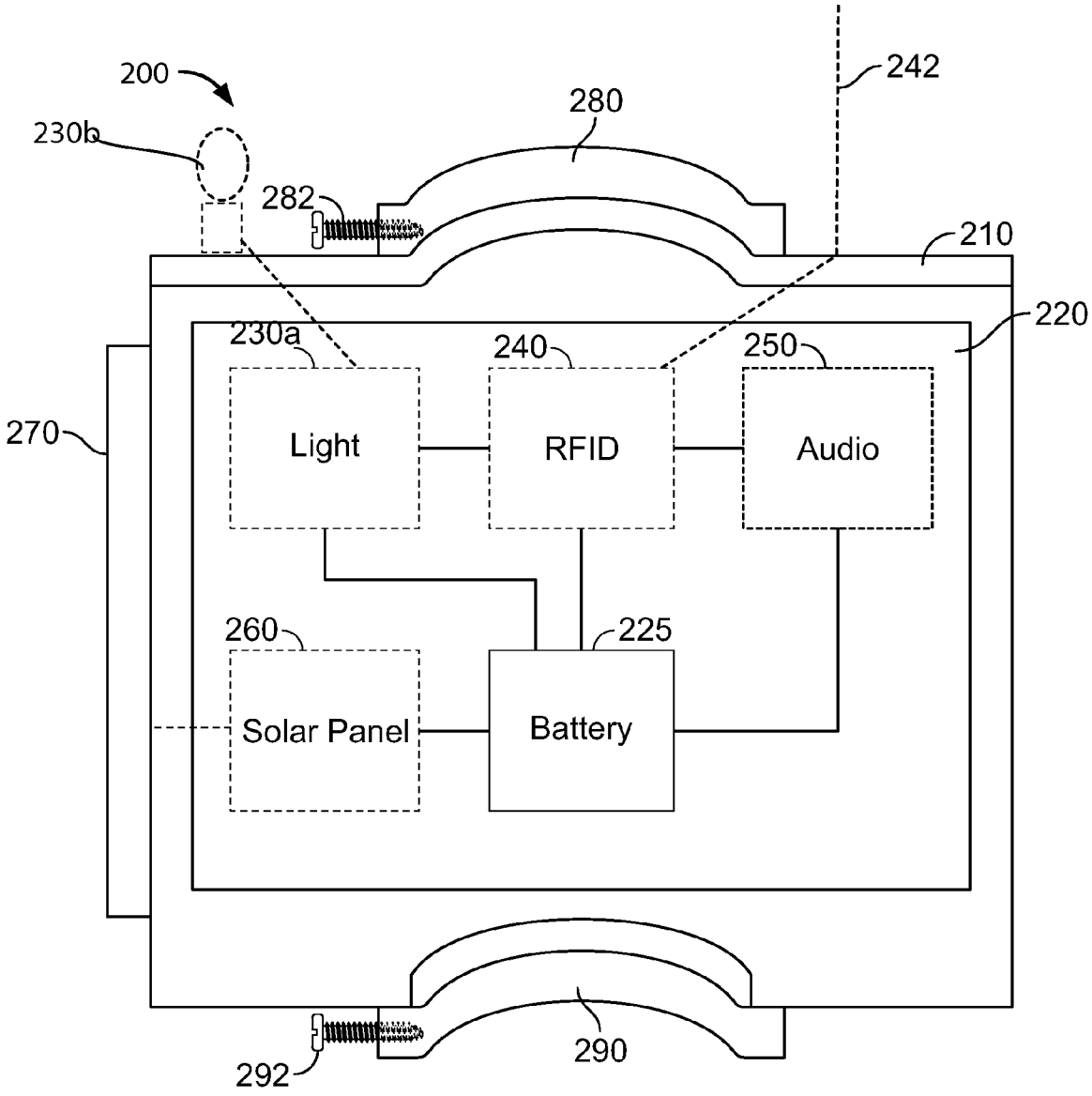
FIG. 3 is a side cross-sectional view of the electronic device shown in FIG. 1.

FIG. 3 shows a side cross-sectional view of an electronic device 200 which can be attached to the grasping device 100 or positioned adjacent to grasping device 100 on shaft 12. Electronic device 200 includes a housing 210, a circuit board 220, a battery 225, and a plurality of optional components wherein one or more of these optional components can be mixed in matched in any desired order and electrically coupled to battery 225. In this case, there can be a light transformer 230*a* for powering a light 230*b* coupled to battery 225, wherein this light is used to illuminate based upon signals sent from a transmitter such as an radio frequency transmitter. Thus, there is an optional RFID transceiver 240 which is in communication with light 230*a* and 230*b* and electrically coupled to battery 225. RFID transceiver 240 is for coupling to an antenna 242 which extends outside or remains internal to housing 210 and which is used to receive signals from a remote control. RFID transceiver 240 can also be used as a locating transceiver so that a remote control can track the location of this transceiver 240.

An optional audio transmitter 250 is disposed inside of housing 210 and coupled to circuit board 220 and also in communication with battery 225. This audio transmitter 250 is also in communication with RFID transceiver 240 wherein if a user using a remote control pushes a button, that user can then send a signal to RFID transceiver 240 to start audio annunciator 250 as well.

Battery 225 can be charged separately or it can be powered by an optional solar powered panel. Thus, disposed inside of housing 210 is a solar panel transformer 260 which is coupled to a solar panel 270 on an exterior of body 210. Solar panel transformer 260 receives electrical input from solar panel 270 and stores this energy in battery 225. The presence of this solar panel 270 and solar panel transformer 260 allows the battery 225 to be consistently recharged while it only temporarily used to power light 230*b* audio transmitter 250 or transceiver 250.

Coupled to housing 210 are locking elements couplers, or collars 280 and 290. Collar 280 is positioned at a first end of housing 210 while collar 290 is positioned at a second end of housing 210. Collar 280 can be in the form of a clamping collar which clamps down on shaft 12 when set by a set screw, or it can be secured by set screw 282 which is screwed in laterally to collar 280 and which clamps directly to shaft 12. In addition, collar 290 can be in the form of a clamping collar 290 which clamps down on shaft 12 when set by a set screw or secured via set screw 292 which is screwed in laterally to collar 290 and which clamps directly to shaft 12. Thus, the position of housing 210 can be set by these set screws 282, and 292 and also by collars 280 and 290 which form locking elements so that the position of this electronic device 200 can be positioned either above, or below grasping device 100.

Thus, grasping device 100 has loops 112, 114, 116 and 118 or openings which allow this grasping device to be grasped. In addition, grasping device 100 is formed as an adjustable device which can be slid over a top section of a shaft 12 of a mast buoy as an after market part. This device 100 can then be positioned at any point along this shaft, and then simply fixed to this shaft via at least one set screw 122 or 132. This grasping device makes it easier for parties to grasp this device using a boat hook or his or her hands when a user on a boat approaches a mooring. The optional electronic device 200 can also be attached to shaft 12 as well. This optional electronic device can be used to aid the user in locating the mast buoy as well as the grasping device to create an easily findable and graspable device that can be attached to a mast buoy to aid a user in mooring his or her boat.

Figure 4:
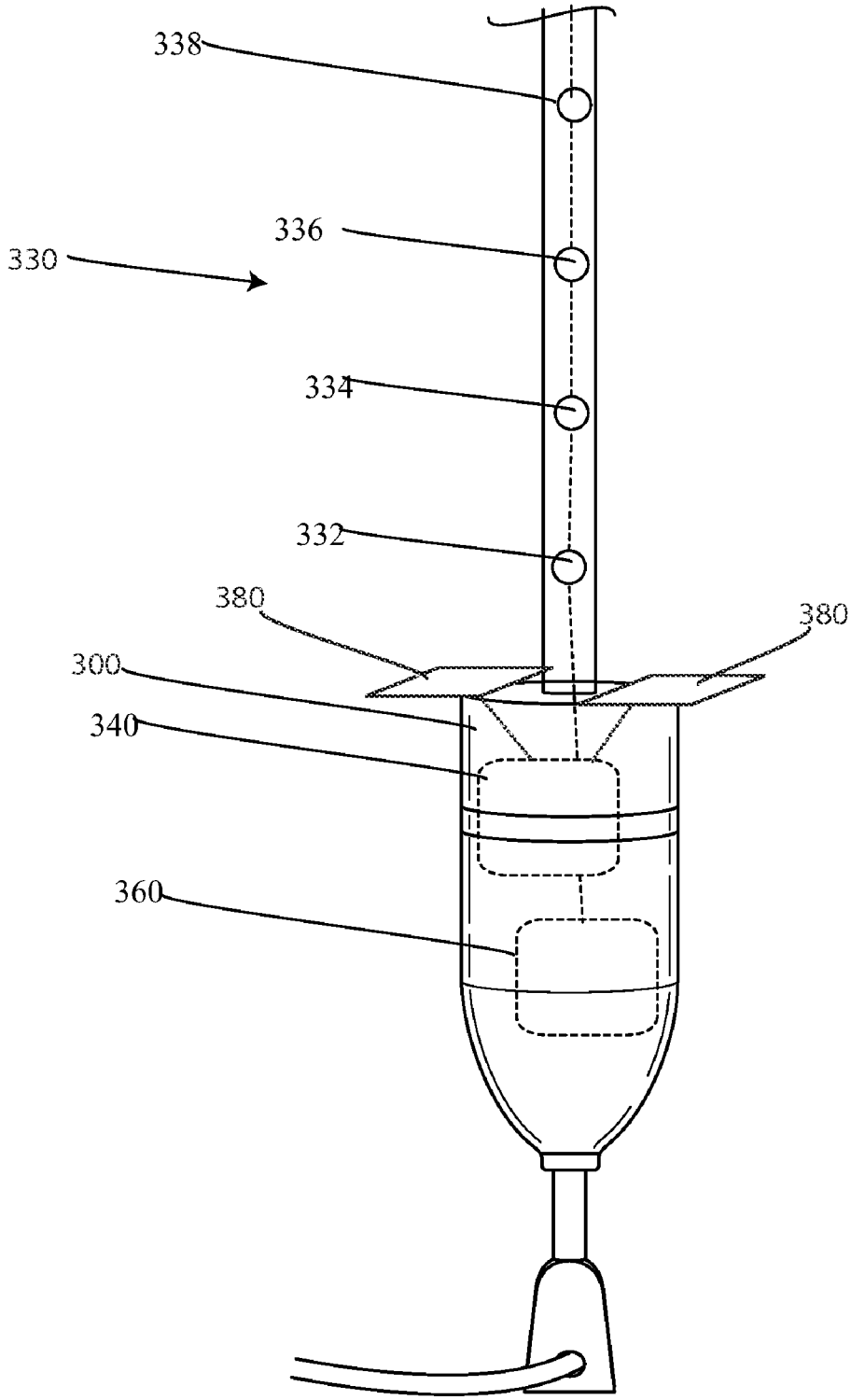
FIG. 4 is a side view of another embodiment.

In another embodiment of the invention, FIG. 4 shows a locating device for a mast buoy. In this embodiment, the device comprises: a base 300 having a housing, a shaft 310 coupled to the base 300. There is at least one light 330 embedded in said shaft, wherein this at least one light can also be a light array such as a plurality of LED lights 332, 334, 336, and 338. There is also at least one power supply disposed in the base 300, wherein the light 330 is coupled to the power supply to receive power from the power supply 340. In this way, the embedded lights can also be activated by a RFID transceiver or receiver 360, which selectively turns on or off light 330 or light array comprising lights 332, 334, 336 and 338 when RFID transceiver 360 receives a signal from a remote control. In addition the power supply or battery 340 can be charged from an optional solar panel system 380, which includes a solar panel and an optional transformer for connection to a battery 340. The solar panel system is for providing power to the battery and which then powers light 330.

Accordingly, while only a few embodiments of the present invention have been shown and described, it is obvious that many changes and modifications may be made thereunto without departing from the spirit and scope of the invention.

REFERENCE SYMBOL LIST

Finder device 10
mast 12
mast buoy 11
flotation element 14
weight 16
linking element 17
mooring ball 18
ring 19
line 20*a*
line 20*b*
chain 22
anchor 24
grasping device 100
body 102
shaft 103
shaft 105
collar 120
collar 130
Loops 112, 114, 116, 118
set screws 122, 132
boat hook 180
electronic device 200
housing 210
circuit board 220
battery 225
light transformer 230*a*
light 230*b*
transceiver 240
antenna 242
audio transmitter 250
solar panel transformer 260
solar panel 270
collar/coupler 280
collar/coupler 290
set screws 282, 292
body 300
lights 330, 332, 334, 336, 338
Power supply 340
RFID transceiver 360
Solar Panel System 380

What is claimed is:

1. A device for a mast buoy having a shaft, the device comprising:

a) a first coupling coupled to the shaft;

b) a second coupling coupled to the shaft at another position on the shaft;

c) at least one loop coupled at a first end to said first coupling and at a second end to said second coupling wherein said at least one loop is made from an elastic or flexible material; and d) at least two locking elements with a first locking element coupled to said first coupling and a second locking element coupled to said second coupling, for locking said couplings to the shaft of the mast buoy wherein said at least one loop extends along a first position to a second position along a length of the shaft of the mast buoy wherein said at least one loop is configured to be compressed when said locking elements lock said couplings to the shaft, such that said at least one loop extends laterally from the shaft.

2. The device as in claim 1, wherein said at least one loop is made from a flexible or elastic material, and wherein said at least one locking element is configured to couple to an outside surface of the shaft.

3. The device as in claim 1, wherein said at least one loop is made from plastic, and wherein said at least one loop is configured to extend along a length of a shaft of a mast buoy, and wherein said at least one loop is configured to retain its shape when said couplings are locked to the shaft.

4. The device as in claim 1, wherein said first and second couplings comprise a telescoping body having at least two shafts with a first shaft being slidable inside a second shaft to adjust a length of said body.

5. The device as in claim 3, wherein said at least one loop is made from an elastic or flexible material and wherein said at least one loop comprises a plurality of loops wherein each coupling of each loop is configured to slide along a length of a mast buoy.

6. The device as in claim 5, wherein said first locking element coupled to a first end of said at least one loop and a second locking element coupled to a second end of said at least one loop, wherein said at least one loop and said first locking element and said second locking element are adapted so that when said at least one loop is adjusted in length, said at least one loop adjusts laterally in relation to said body.

7. The device as in claim 1, wherein said at least two locking elements are configured to allow said body to be removed from the shaft on the mast buoy and wherein said at least two locking elements are configured to be adjusted from a locked position to an unlocked position to allow said body to be removed from the shaft on the mast buoy, wherein said at least two locking elements are configured to be adjustable in position along the shaft so that said at least two locking elements are positionable at different lengths of the shaft.

8. The device as in claim 1, wherein said at least two locking elements are configured to be coupled to the shaft of the mast buoy and slidable along the shaft of the mast buoy.

9. The device as in claim 8, wherein said-at least two collars are configured to be positioned on the shaft of the mast buoy to secure said at least one loop to the shaft of the mast buoy.

10. The device as in claim 9, wherein said at least two collars each comprise at least one set screw for setting a position of each of said at least two collars on the mast of the mast buoy.

11. The device as in claim 1, further comprising at least one light coupled to the shaft of a mast buoy.

12. The device as in claim 11, further comprising a housing, wherein said light is coupled to said housing, and wherein said light housing further comprises at least one coupler for coupling said at least one light housing to the shaft of a mast buoy.

13. The device as in claim 12, further comprising at least one battery disposed in said housing, said battery for powering said light.

14. The device as in claim 13, further comprising at least one solar panel coupled to said housing, said solar panel for providing power to said battery.

15. The device as in claim 12, further comprising at least one receiver disposed in said housing, said receiver for selectively turning on or off said light disposed in said housing.

16. The device as in claim 15, wherein said receiver is in the form of a RFID transceiver which transmits radio frequency communications to a remote control.

17. The device as in claim 15, further comprising at least one audio transmitter for transmitting an audible sound, said audio transmitter being in communication with said RFID transceiver to selectively actuate said at least one audio transmitter.

18. A grasping and locating device for a mast buoy having a shaft, the device comprising:

a) at least one electrical component housing;

b) at least two locking elements, coupled to said electrical component housing, and wherein at least one locking element is configured to removably couple said electrical component housing to the shaft of the mast buoy wherein said locking element is configured to be adjusted from a locked position to an unlocked position to allow said electrical component housing to be removed from the shaft of the mast buoy; and c) at least one loop coupled at a first end to a first of said at least two locking elements and at a second end to a second of said at least two locking elements, and extending along a length of the shaft of the mast buoy;

d) at least one light coupled to said at least one electrical component housing.

19. The device as in claim 18 further comprising:

at least one solar panel coupled to said at least one electrical component housing;

at least one RFID receiver disposed in said electrical component housing;

at least one audio transmitter disposed in said electrical component housing; and at least one battery for powering said light, said RFID receiver and said at least one audio transmitter, wherein said at least one solar panel is configured to provide power to said at least one battery.

20. A locating device for a mast buoy, the device comprising:

at least two locking elements, comprising a first locking element and a second locking element;

a shaft coupled to said at least two locking elements;

a plurality of lights embedded along said shaft, and at least one power supply disposed in at least one of said at least two locking elements, wherein said at least one light is coupled to said at least one power supply;

at least one electrical component coupled to said shaft and said power supply;

at least one loop coupled at a first end to said first locking element and at a second end to said second locking element said at least one loop extending along a length of the shaft such that an extension of said loop is entirely within a length of said shaft;

at least two locking elements, wherein said at least two locking elements are for removably coupling said electrical component housing to said shaft wherein said locking elements are configured to be adjusted from a locked position to an unlocked position to allow said electrical component housing to be removed from said shaft.

21. A mast buoy device comprising:

a) a shaft;

b) at least one coupling coupled to said shaft;

c) at least one elastic or flexible material coupled to said at least one coupling; and d) at least one locking element coupled to said at least one coupling for locking said at least one coupling to said shaft wherein said locking element is configured to allow said at least one coupling to be removed from said shaft and wherein said locking element is configured to be adjusted from a locked position to an unlocked position to allow said at least one coupling to be removed from said shaft, wherein said at least one locking element is slidable along said shaft and is configured to be coupled to said shaft in at least two positions along said shaft wherein said at least one locking element is configured to be coupled to an outside surface of said shaft wherein said at least one flexible material is configured to extend entirely along a length of said shaft wherein said at least one flexible material is configured to be compressed when said locking elements lock said couplings to the shaft, such that said at least one flexible material extends laterally from the shaft.

22. The mast buoy device as in claim 21, wherein said shaft is a telescoping shaft.

23. The device as in claim 1, wherein said at least one loop comprises a plurality of loops that change in shape when at least one coupling element is moved along said shaft.

24. The device as in claim 21, wherein said at least one loop comprises a plurality of loops that change in shape when at least one coupling element is moved along said shaft.

* * * * *